US007071918B2

(12) United States Patent
Nakamura

(10) Patent No.: US 7,071,918 B2
(45) **Date of Patent: *Jul. 4, 2006**

(54) VOLUME-INTEGRAL TYPE MULTI DIRECTIONAL INPUT APPARATUS

(75) Inventor: Masahiko Nakamura, Nara-ken (JP)

(73) Assignee: Hosiden Corporation, Yao (JP)

( * ) Notice: Subject to any disclaimer, the term of this patent is extended or adjusted under 35 U.S.C. 154(b) by 430 days.

This patent is subject to a terminal disclaimer.

(21) Appl. No.: 10/122,124

(22) Filed: Apr. 15, 2002

(65) Prior Publication Data

US 2002/0186205 A1 Dec. 12, 2002

Related U.S. Application Data

(63) Continuation-in-part of application No. 09/807,954, filed as application No. PCT/JP00/05358 on Aug. 10, 2000, now Pat. No. 6,670,945.

(30) Foreign Application Priority Data

Jan. 28, 2000 (JP) ..... 2000-19852

(51) Int. Cl.
*G09G 5/08* (2006.01)

(52) U.S. Cl. ..... 345/161; 345/156; 345/157; 345/158; 345/166; 345/167

(58) Field of Classification Search ..... 345/156–184, 345/764, 473, 433, 457, 419, 420; 200/6; 338/128; 463/38; 703/2; 364/460, 560, 364/578; 382/187, 199; 178/18, 19
See application file for complete search history.

(56) References Cited

U.S. PATENT DOCUMENTS 6,171,191 B1 * 1/2001 Ogata et al. ..... 463/38
6,256,011 B1 * 7/2001 Culver ..... 345/157
6,275,139 B1 * 8/2001 Shimomura et al. ..... 338/128
6,344,620 B1 * 2/2002 Nakamura ..... 200/6 A
6,363,325 B1 * 3/2002 Bates et al. ..... 701/301
6,509,535 B1 * 1/2003 Nakamura ..... 200/6 A
6,545,664 B1 * 4/2003 Kim ..... 345/158
6,641,479 B1 * 11/2003 Ogata et al. ..... 463/37
6,670,945 B1 * 12/2003 Nakamura ..... 345/156

(Continued)

FOREIGN PATENT DOCUMENTS

DE 1 947 739 4/1971

(Continued)

OTHER PUBLICATIONS

Notification of Reasons for Refusal, relating to corresponding Appl. No. 2000-019852, dispatch date Feb. 17, 2004, with English translation.

(Continued)

*Primary Examiner*—Vijay Shankar
*Assistant Examiner*—Prabodh Dharia
(74) *Attorney, Agent, or Firm*—Armstrong, Kratz, Quintos, Hanson & Brooks, LLP.

(57) ABSTRACT

A multi-directional input apparatus having a volume as a signal output in which the number of parts of the multi-directional input apparatus is reduced. Turning members 40A and 40B which are turned when an operating member 30 is operated are combined at right angles in a case 10. The turning members 40A and 40B are provided at their one ends with gears 44A and 44B. Straight-ahead sliders 80 and 80 are mounted on two crossing side surfaces of the case 10 along the side surfaces and a mounting board of the input apparatus.

8 Claims, 23 Drawing Sheets

U.S. PATENT DOCUMENTS

| | | | | |
|---|---|---|---|---|
| 2001/0028361 | A1* | 10/2001 | Culver | 345/701 |
| 2002/0036617 | A1* | 3/2002 | Pryor | 345/156 |
| 2002/0067355 | A1* | 6/2002 | Randel | 345/426 |
| 2005/0128186 | A1* | 6/2005 | Shahoian et al. | 345/161 |

FOREIGN PATENT DOCUMENTS

| | | |
|---|---|---|
| JP | 50-94432 | 12/1973 |
| JP | 51-58328 | 10/1974 |
| JP | 52-67301 | 11/1975 |
| JP | 61-25207 | 7/1986 |
| JP | 4-47721 | 4/1992 |
| JP | 11-024777 | 1/1999 |
| JP | 11-73853 | 3/1999 |

OTHER PUBLICATIONS

Notification of Reasons for Refusal, relating to correapond-ing Appl. No. 2000-019852, dispatch date May 10, 2005, with English translation.

* cited by examiner

A — A

8 - 8

C – C

VOLUME-INTEGRAL TYPE MULTI DIRECTIONAL INPUT APPARATUS

This application is a Continuation-In-Part of prior application Ser. No. 09/807,954 filed Apr. 26, 2001, now U.S. Pat. No. 6,670,945, which is a national stage application under § 371 of international application PCT/JP00/05358 filed Aug. 10, 2000.

FIELD OF THE INVENTION

The present invention relates to a multi-directional input apparatus for inputting various signals by operating an operating member which is operated in arbitrary circumferential direction

BACKGROUND ART

A multi-directional input apparatus of this type called joystick comprises a case secured on a board, a set of upper and lower turning members having long holes each extending in a direction perpendicular to the turning direction, an operating member passing through the long holes of the set of upper and lower turning members for turning the turning members by operating the operating member in an arbitrary circumferential direction, a spring compressed and accommodated in the case for resiliently holding the operating member in its neutral position, and a set of signal output means for outputting a signal corresponding to the turning angle of each the turning member.

As the set of signal output means, a volume such as an electric sensor, a magnetic sensor, optical sensor or the like is used, and the volume is relatively commonly used in terms of costs and the like. Multi-directional input apparatuses using the volume as the set of signal output means are described in Japanese Patent Application Laid-open No. S61-198286, Japanese Utility Model Publication No. H6-43963, and Japanese Utility Model Publication No. H7-27608.

However, the conventional multi-directional input apparatus using the volume as the one set of signal output means has the following problems.

Although the volume is inexpensive as compared with other signal output means, the volume requires a large number of parts (usually five parts), a rate of cost occupied by the volume in the multi-directional input apparatus is still high. Further, since it is necessary to use solder between the multi-directional input apparatus and a board onto which the multi-directional input apparatus is mounted, this increases the manufacturing cost of equipment which uses the multi-directional input apparatus.

The present invention has been accomplished in view of these circumstances, and it is an object of the present invention to provide a volume-integral type multi-directional input apparatus in which the number of parts is small and a board can be mounted easily.

DISCLOSURE OF THE INVENTION

To achieve the above object, the present invention provides a volume-integral type multi-directional input apparatus comprising a case secured on a mounting board; a set of upper and lower turning members supported in the case such as to be directed in two crossing direction and each having a long hole extending in a direction perpendicular to a turning direction; an operating member passing through each of the long holes of the set of upper and lower turning members, the operating member turning each of the turning members when the operating member is operated in arbitrary direction therearound; a holding mechanism for resiliently holding the operating member at a neutral position; and a set of signal output means for outputting signal corresponding to a turning angle of each of the turning members; wherein the set of signal output means comprise a pair of straight-ahead sliders mounted to the case such that the straight-ahead sliders move straightly along a side surface of the case above the mounting board, a pair of motion transmitting mechanisms for converting turning movements of the set of upper and lower turning members into straight movements and transmitting the straight movements to the pair of straight-ahead sliders, and a pair of contacts sliding on resistance circuits when the straight-ahead sliders move straightly, thereby constituting volumes.

According to the volume-integral type multi-directional input apparatus of the present invention, when the operating member is operated, the turning members are turned to move the straight-ahead sliders straightly along side surfaces of the case above the mounting board, the contacts slide on the resistance circuits, and a function as a volume is obtained. If the volume as signal output means is integrally formed on the multi-directional input apparatus in this manner, the number of parts is reduced.

In order to reduce the number of parts, it is preferable that the straight-ahead sliders are accommodated in slider accommodating portions integrally formed on a side surface of the case. That is, the accommodating portion for accommodating the straight-ahead slider may be separately mounted to the case, but it is preferable to integrally form the accommodating portion on the side surface of the case to reduce the number of parts.

In order to reduce the number of parts, it is preferable that the motion transmitting mechanism is a so-called rack and pinion mechanism in which a gear provided on an end of the turning member meshes with a rack gear teeth formed on a surface of the straight-ahead slider Each of the resistance circuits can be formed on a surface of the mounting board to which the case is secured. The resistance circuit can also be formed on a surface of the reserved board for forming the volume separately disposed along a moving surface of the straight-ahead slider.

When the resistance circuit is formed on the surface of the mounting board, the contact is mounted to the lower surface of the straight-ahead slider. In this case, the number of parts is reduced particularly and solder between the board and the circuit is unnecessary.

When the resistance circuit is formed on the surface of the reserved board, i.e., when the reserved board is separately used, the reserved board can be disposed below, above or sideway of the straight-ahead slider, but it is preferable to dispose the resistance circuit below the straight-ahead slider in terms of connection with the mounting board. When the reserved board is disposed below the straight-ahead slider, the contact is preferably mounted to the lower surface of the straight-ahead slider, and when the reserved board is disposed above the straight-ahead slider, the contact is preferably mounted to the upper surface of the straight-ahead slider.

When the resistance circuit constituting the integral type volume is formed on the surface of the mounting board, it is necessary for a user of the multi-directional input apparatus to precisely print and form the resistance circuit. Therefore, the burden of the user is increased, but if the reserved board is used, although the number of parts is increased, it is unnecessary for the user of the multi-directional input apparatus to print and form the resistance circuit on the mounting board, and this reduces the burden of the user.

It is preferable that the reserved board is bent into an L-shape along two crossing side surfaces of the case, and is commonly used by the pair of volumes. With this structure, the increase in the number of parts caused by the reserved board is minimized.

In order to reduce the number of parts, it is preferable that the reserved board is accommodated together with the straight-ahead slider in a slider accommodating portion which is integrally formed on a side surface of the case. It is preferable that the reserved board is a flexible board in view of wiring with respect to the mounting board.

A fan-like member having an arc surface formed with teeth is preferable as the gear constituting the motion transmitting mechanism because the apparatus can be made small. It is preferable that it is integrally formed on the end of the turning member because the number of parts is reduced.

Structures of portions other than the volume are not limited. For example, the holding mechanism for resiliently holding the operating member at the neutral position may directly hold the operating member at the neutral position, or may indirectly hold the set of upper and lower operating members at the neutral position using spring, or may directly hold both the operating members at the neutral position. The spring may be disposed on either upper or lower one of the set of the upper and lower turning members.

EXPLANATION OF SYMBOLS

| | |
|---|---|
| 10 | case |
| 10a | lower case |
| 10b | upper case |
| 15 | body |
| 16 | slider accommodating portion |
| 20A, 20B | volume section (signal output means) |
| 30 | operating member |
| 40A, 40B | turning member |
| 41A, 41B | turning shaft |
| 42A, 42B | arc portion |
| 43A, 43B | long hole |
| 44A, 44B | gear |
| 45A, 45B | teeth |
| 50 | hoisting and lowering slider |
| 60 | spring |
| 70 | hoisting and lowering member |
| 80 | straight-ahead slider |
| 82 | teeth |
| 90 | contact |
| 100 | mounting board |
| 110 | pushdown switch |
| 120 | resistance circuit |
| 130 | reserved board |

EMBODIMENT OF THE INVENTION

Figure 1:
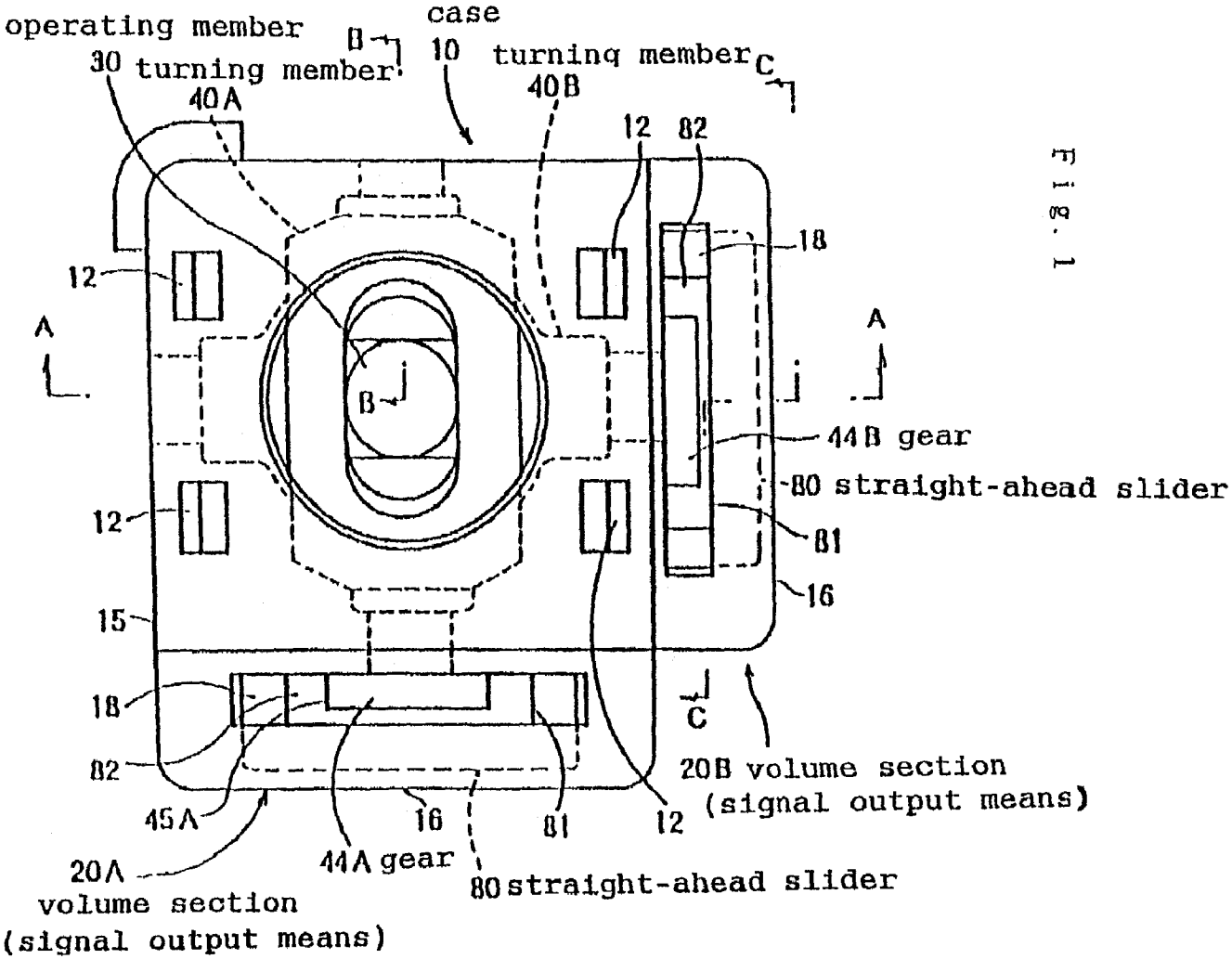
FIG. 1 is a plan view of a volume-integral type multi-directional input apparatus according to a first embodiment of the present invention.

Embodiments of the present invention will be explained based on the drawings below. As shown in FIG. 1, in a volume-integral type multi-directional input apparatus of a first embodiment of the present invention, a case 10 is secured on a mounting board 100 (see FIG. 6), and the case 10 is integrally provided at its two side with a set of volume sections 20A and 20B as signal output means.

Figure 2:
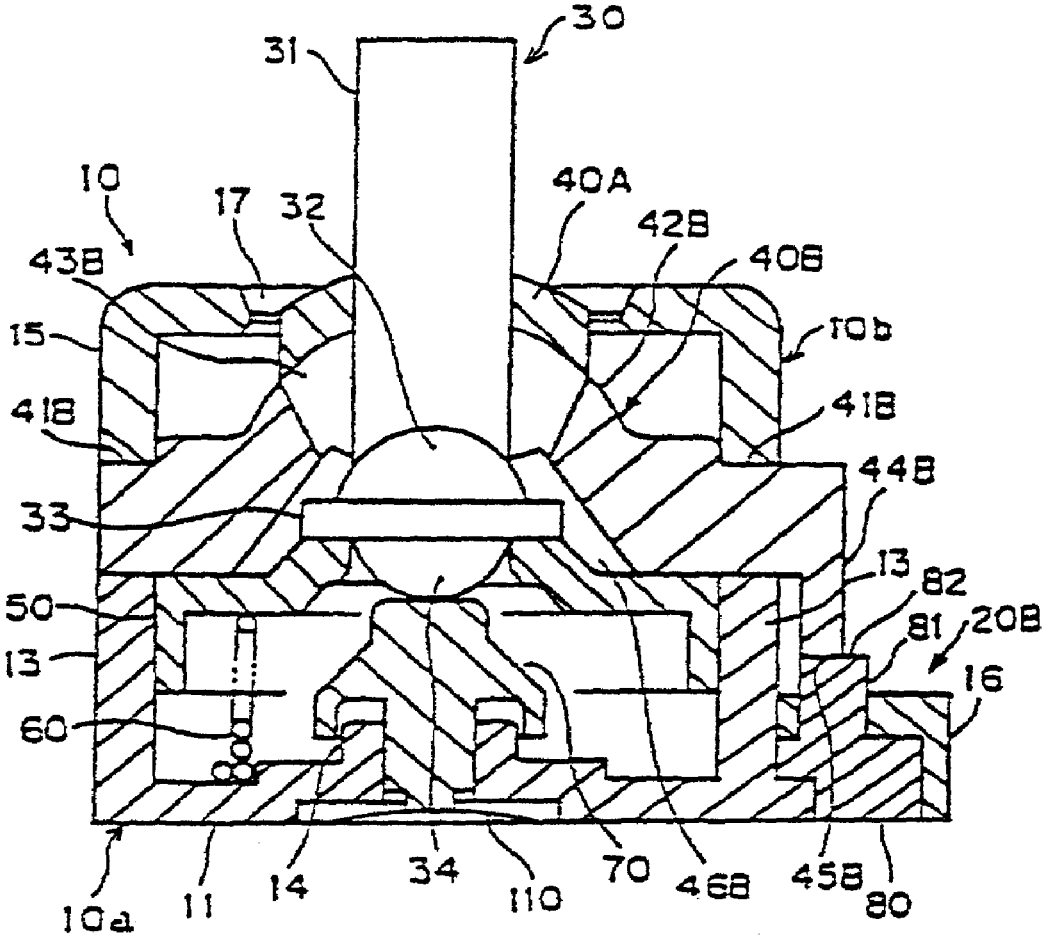
FIG. 2 is a sectional view taken along an arrow A—A in FIG. 1.
Figure 3:
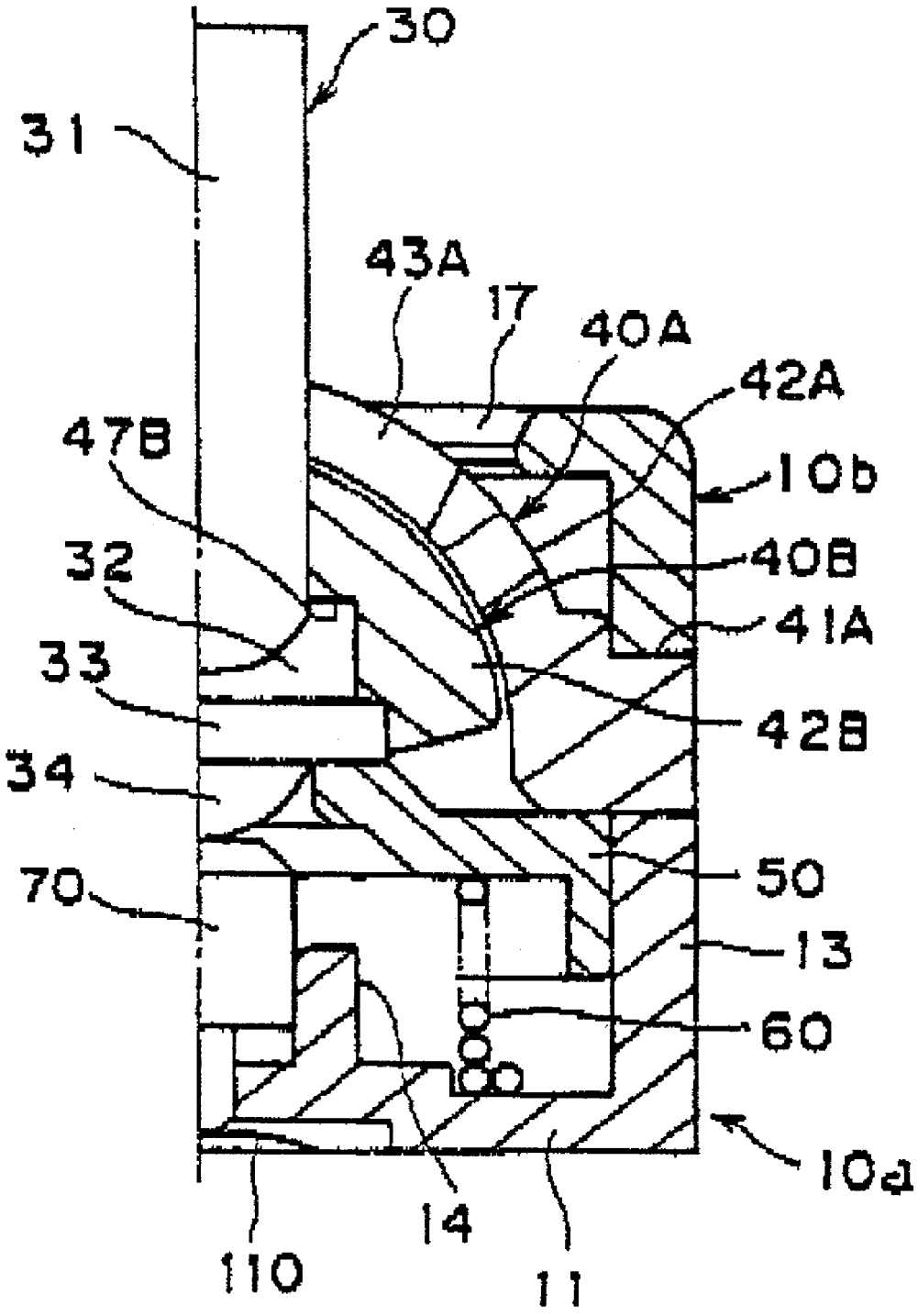
FIG. 3 is a sectional view taken along an arrow B—B in FIG. 1.
Figure 4:
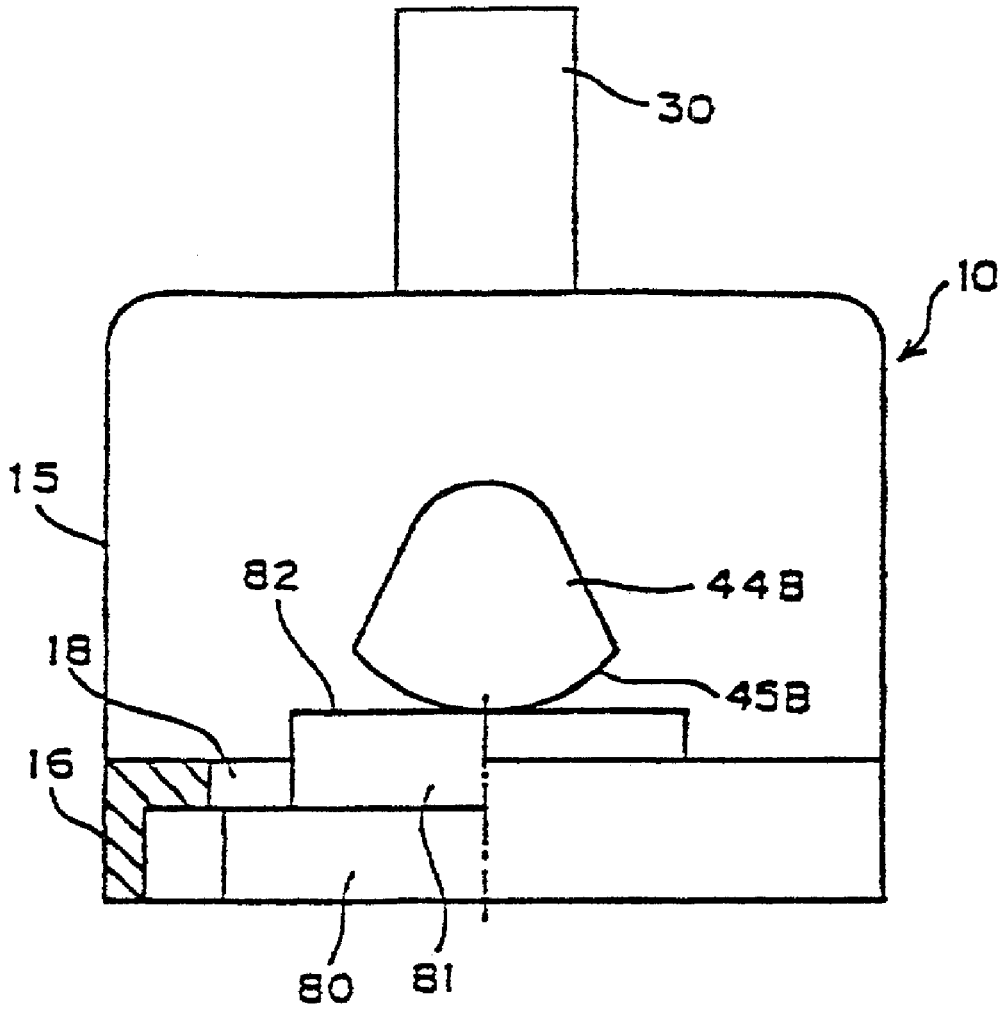
FIG. 4 is a sectional view taken along an arrow C—C in FIG. 1.

As shown in FIGS. 2 and 3, accommodated in a body of the case 10 excluding the volume sections 20A and 20B are a rod-like operating member 30 inclingly operated in arbitrary circumferential direction around its lower portion, a set of upper and lower turning members 40A and 40B, a hoisting and lowering slider 50 and a spring 60 for resiliently holding the operating member 30 at its neutral position, and a hoisting and lowering member 70 which is operated up and down by the operating member 30. The volume sections 20A and 20B are provided therein with straight-ahead sliders 80 and 80.

The box-like case 10 secured on the mounting board 100 (see FIG. 6) is of a two-piece structure comprising a lower case 10*a* forming a bottom plate of the case 10 and an upper case 10*b* placed on the lower case 10*a* from above.

The lower case 10*a* has a substantially quadrangle bottom plate 11. The bottom plate 11 is provided at its four corners with pawls 12 which are upwardly projecting for securing the upper case 10*b* to the bottom plate 11. A support 13 is projected from a central portion of sides of the bottom plate 11 for supporting the turning members 40A and 40B. The bottom plate 11 is provided at its central portion with a cylindrical guide 14 for vertically guiding a hoisting and lowering member 70.

The upper case 10*b* includes a box-like body 15 which is to be put on the lower case 10*a* and whose bottom is opened. The upper case 10*b* also includes slider accommodating portions 16 and 16. The body 15 is provided at its ceiling with and opening 17 through which the operating member 30 projects. The body 15 is provided at its side walls with notches into which the support 13 of the lower case 10*a* is fitted.

As shown in FIGS. 1, 2, 4 and 5, each of the slider accommodating portions 16 and 16 accommodating the straight-ahead slider 80 is a regular hexahedronal box expanded from the lower side surface sideway, and a lower surface of the slider accommodating portion 16 is entirely opened. Each of the slider accommodating portions 16 and 16 is provided at its upper surface with a slit-like opening 18 along a side surface of the body 15.

When the upper case 10*b* is put on the lower case 10*a*, the pawls 12 of the lower case 10*a* engage an inner surface of a side wall of body 15 of the upper case 10*b* so that the lower case 10*a* and the upper case 10*b* are secured to each other. When the support 13 of the lower case 10*a* is fitted to the notches of the body 15 of the upper case 10*b*, each of the side surfaces of the body 15 is formed with a circle opening for supporting opposite end shafts of the turning members 40A and 40B.

As shown in FIGS. 2 and 3, the operating member 30 includes a rod 31 having a circular cross section, a turning shaft 32 continuously formed on a lower portion of the rod 31, a large-diameter disc 33 continuously formed on a further lower portion of the turning shaft 32, and a downwardly swelling semi-circular projection 34 formed on a central portion of a lower surface of the disc 33. The disc 33 has an upwardly swelling semi-circular cross-section, and is projecting in two directions perpendicular to the turning shaft 32. An axial center of the turning shaft 32 crosses the center of the downwardly swelling semi-circular projection 34.

The upper turning member 40A has turning shafts 41A and 41A, and an upwardly swelling arc 43A. The arc 43A is provided with a long hole 43A extending toward the turning center axis. The long hole 43A functions as a guide hole for the operating member 30. A gear 44A is integrally formed on a tip end surface of one of the turning shafts 41A and 41A. The gear 44A projects sideway of the body 15, and is located above the opening 18 of one of the slider accommodating portions 16 and 16. The gear 44A has a fan-like shape whose arc surface is directed downward, and the arc surface is formed with spur wheel teeth 45A.

The lower turning member 40B is combined with below the upper turning member 40A perpendicularly. The turning member 40B is provided at its opposite ends with turning shafts 41B and 41B each having a circular cross section. The turning member 40B is provided with an upwardly swelling semi-spherical arc 42B formed between the turning shafts 41B and 41B. The semi-spherical arc 42B is provided with a long hole 43B extending toward the turning center axis. The long hole 43A functions as a guide hole for the operating member 30.

The semi-spherical arc 42B is provided at its lower surface with a recess 46B into which the disc 33 of the operating member 30 is fitted. The recess 46B ensures the turning movement of the disc 33 when the operating member 30 is operated toward the long hole 43B of the turning member 40B. A pair of recessed bearings 47B and 47B are provided in an inner surface of the recess 46B such as to sandwich the long hole 43B. The turning shaft 32 of the operating member 30 is fitted to the bearings 47B and 47B.

A gear 44B is integrally formed on a tip end surface of one of the turning shafts 41B and 41B. The gear 44B projects sideway of the body 15, and is located above the other one of the slider accommodating portions 16 and 16. The gear 44B has a fan-like shape whose arc surface is directed downward, and the arc surface is formed with spur wheel teeth 45B.

The hoisting and lowering slider 50 for resiliently holding the operating member 30 at the neutral position is annular in shape so that the hoisting and lowering slider 50 can vertically movably fitted in the body 15 of the case 10. The hoisting and lowering slider 50 is disposed below the turning members 40A and 40B, and is biased upward by the spring 60 compressed and accommodated between the hoisting and lowering slider 50 and the bottom plate 11 of the case 10.

The hoisting and lowering slider 50 is biased and resiliently brought into contact with flat a lower surface of the disc 33 of the operating member 30 and flat surfaces formed on the lower surfaces of the turning members 40A and 40B, thereby directly holding the operating member 30 and the turning members 40A and 40B at the neutral position.

The hoisting and lowering member 70 vertically moved by the operating member 30 is inserted into the cylindrical guide 14 formed at the central portion of the bottom plate 11 of the case 10, and is biased upward by a pushdown switch 110 on the mounting board 100.

The straight-ahead sliders 80 and 80 accommodated in the slider accommodating portions 16 and 16 of the case 10 are capable of moving horizontally along a side surface of the body 15, and the straight-ahead sliders 80 and 80 are prevented from being pulled out downward by means of the side edge of the bottom plate 11 of the lower case 10*a*. Each of the straight-ahead sliders 80 and 80 is provided at its upper portion with a projection 81 projecting upward of the slider accommodating portion 16 through the slit-like opening 18 formed in the upper surface of the slider accommodating portions 16 and 16. The projection 81 is formed at its upper surface with rack gear teeth 82 in the moving direction of the straight-ahead slider 80. The teeth 82 meshes with the teeth 45A and 45B of the fan-like gears 44A and 44B formed on one ends of the turning members 40A and 40B, thereby constituting a motion transmitting mechanism.

Figure 5:
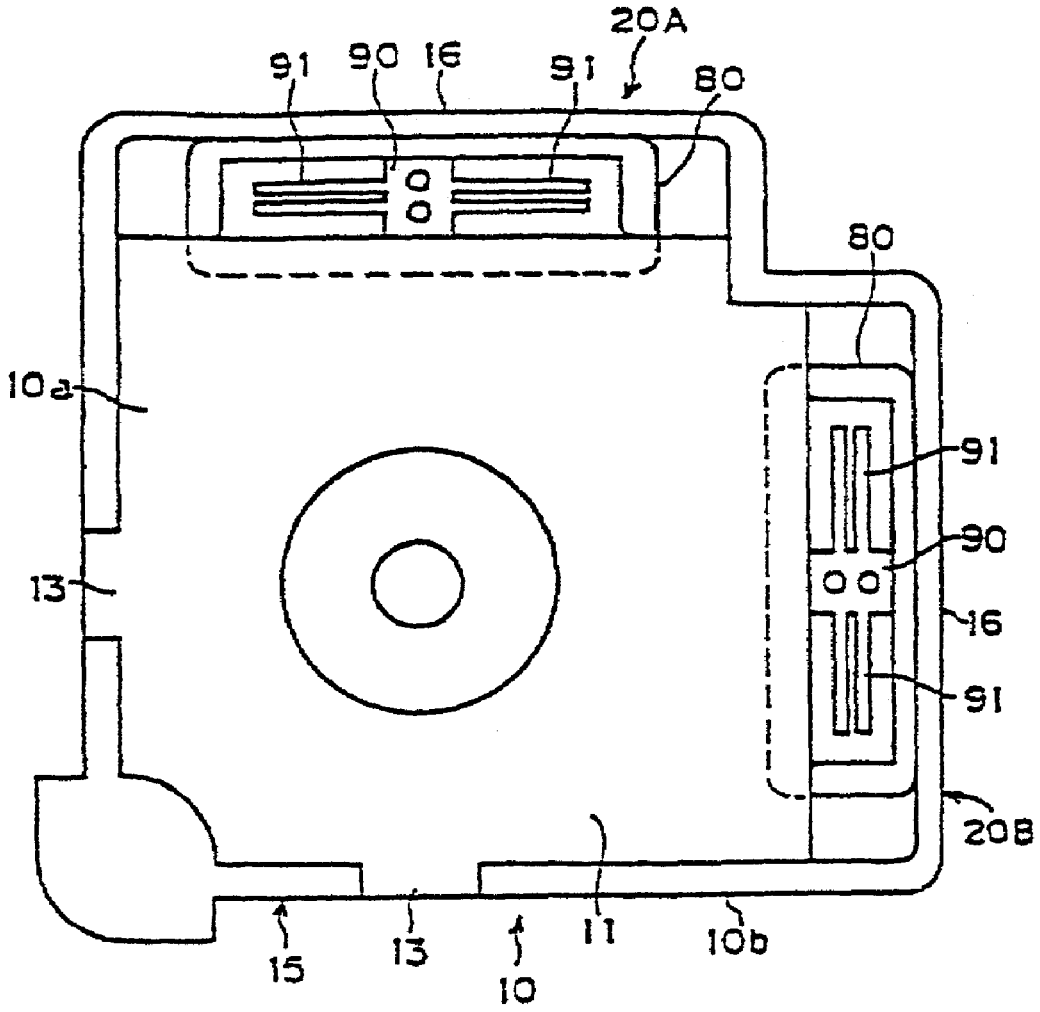
FIG. 5 is a bottom view of the multi-directional input apparatus.

As shown in FIG. 5, a contact 90 is mounted to a lower surface of each of the straight-ahead sliders 80 and 80. The contact 90 faces a surface of the mounting board 100 through the opening formed in the lower surface of the slider accommodating portion 16, and is resiliently contacted with a resistance circuit 120 (see FIG. 6) formed on the surface of the mounting board 100.

Figure 6:
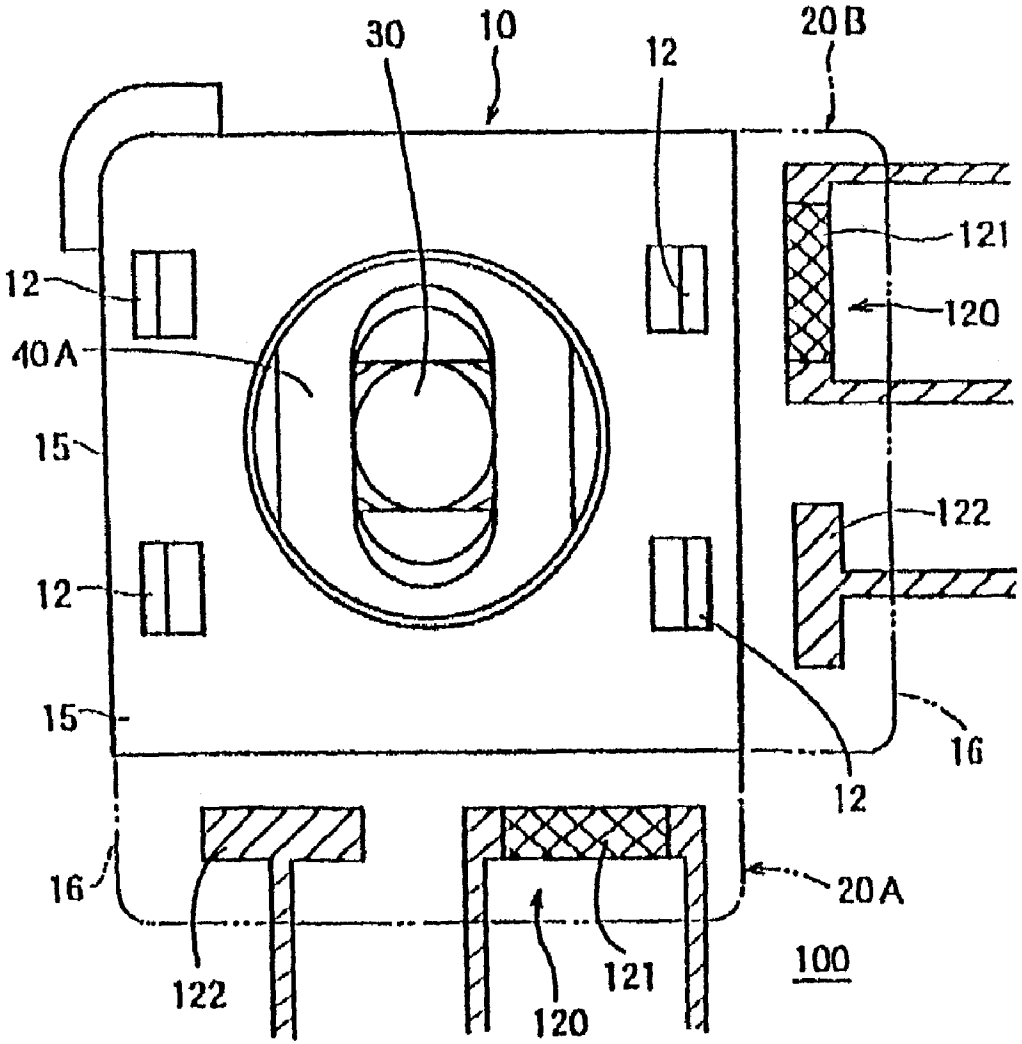
FIG. 6 is a pattern circuit diagram of a resistant circuit combined with the multi-directional input apparatus.

As shown in FIG. 6, the resistance circuits 120 are located below volume portions 20A and 20B, and formed on the surface of the mounting board 100. Each of the resistance circuits 120 includes a carbon resistor 121 and conductive portion 122 arranged straightly at a distance therebetween. The contact 90 includes a pair of contacting portions 91 and 91 arranged straightly so that they come into contact with the carbon resistor 121 and the conductive portion 122. The carbon resistor 121 and the conductive portion 122 are brought into conduction to constitute the volume.

Next, a function of the volume-integral type multi-directional input apparatus according to the first embodiment of the present invention will be explained.

If the operating member 30 is inclined toward the long hole 43B of the lower turning member 40B, the upper turning member 40A is turned. With this movement, the volume portion 20A is operated, and a resistance value corresponding to the operation amount is obtained. That is, in the volume portion 20A, the gear 44A is turned by the turning movement of the turning member 40A, thereby straightly moving the straight-ahead slider 80, the contact 90 slides on the corresponding resistance circuit 120, and a resistance value corresponding to the operation amount is obtained.

If the operating member 30 is inclined toward the long hole 44A of the upper turning member 40A, the lower turning member 40B is turned. With this movement, the volume portion 20B is operated, and a resistance value corresponding to the operation amount is obtained. That is, in the volume portion 20B, the gear 44B is turned by the turning movement of the turning member 40B, thereby straightly moving the straight-ahead slider 80, the contact 90 slides on the corresponding resistance circuit 120, and a resistance value corresponding to the operation amount is obtained.

The operating member 30 is operated in an arbitrary direction by a combination of the above movements, and a signal in accordance with the operation direction and amount is input to electronic equipment which uses the multi-directional input apparatus.

If the operating member 30 is pushed down in the axial direction, the pushdown switch 110 on the mounting board 100 is operated.

The volume portions 20A and 20B comprise the slider accommodating portions 16 and 16 provided on the two perpendicular side surfaces of the case 10, the fan-like gears 44A and 44B provided on one ends of the turning members 40A and 40B, and the straight-ahead sliders 80 and 80 accommodated in the slider accommodating portions 16 and 16, and the contacts 90 and 80 mounted to the lower surfaces of the straight-ahead sliders 80 and 80. Among these constituent parts, the slider accommodating portions 16 and 16 and the gears 44A and 44B are integrally formed together with the existing constituent elements of the multi-directional input apparatus. Therefore, the parts required for constitute the volume portions 20A and 20B are two parts, i.e., the straight-ahead sliders 80 and 80 and the contacts 90 and 90.

Therefore, the number of parts is largely reduced as compared with the conventional multi-directional input apparatus using the external volume, and the cost is also reduced. Further, the volume portions 20A and 20B do not require soldering between the resistance circuits 120 and 120 on the mounting board 100. Therefore, the assembling cost of electronic equipment which uses the multi-directional input apparatus can be reduced.

Figure 7:
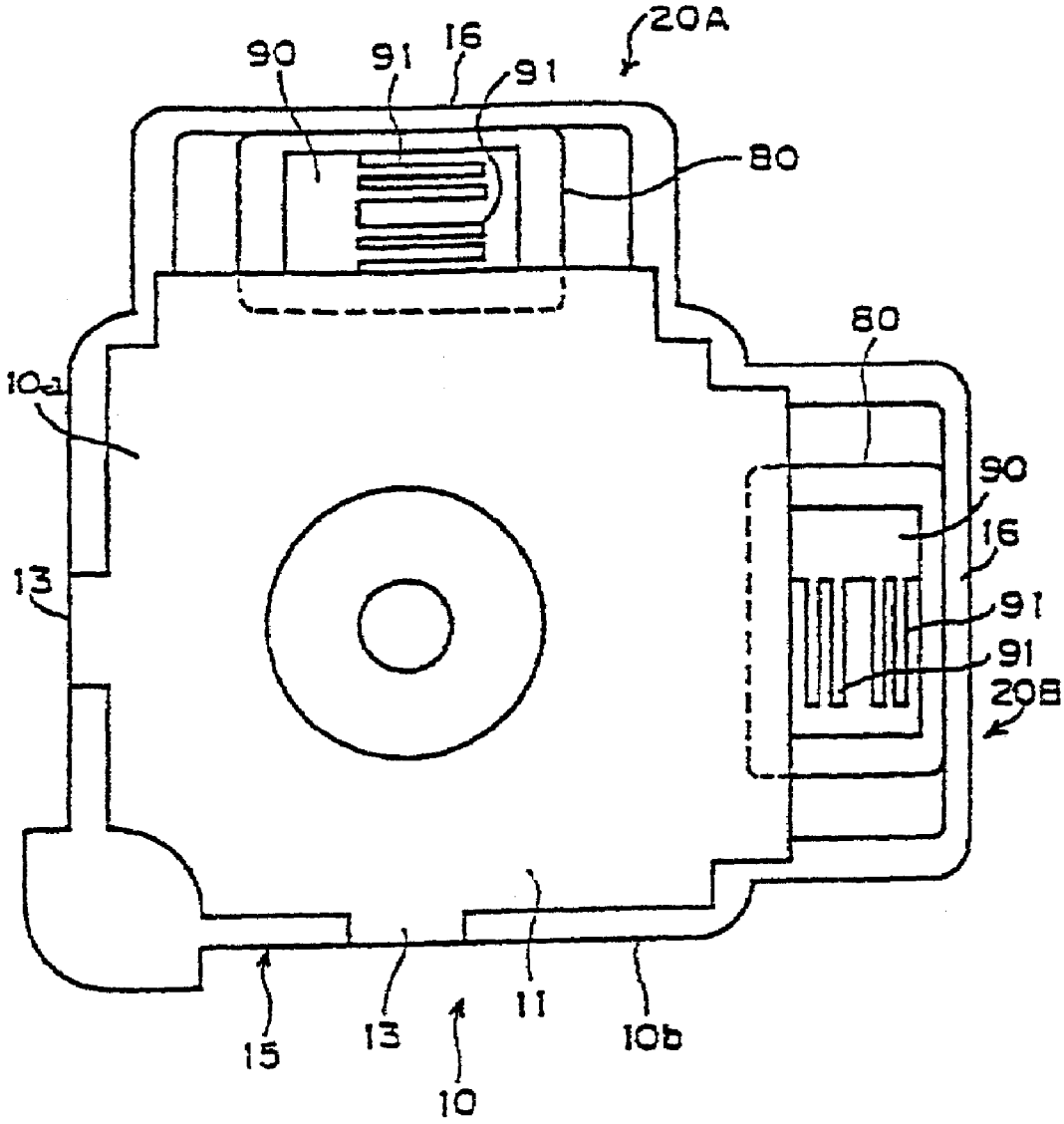
FIG. 7 is a bottom view of a volume-integral type multi-directional input apparatus according to a second embodiment of the present invention.
Figure 8:
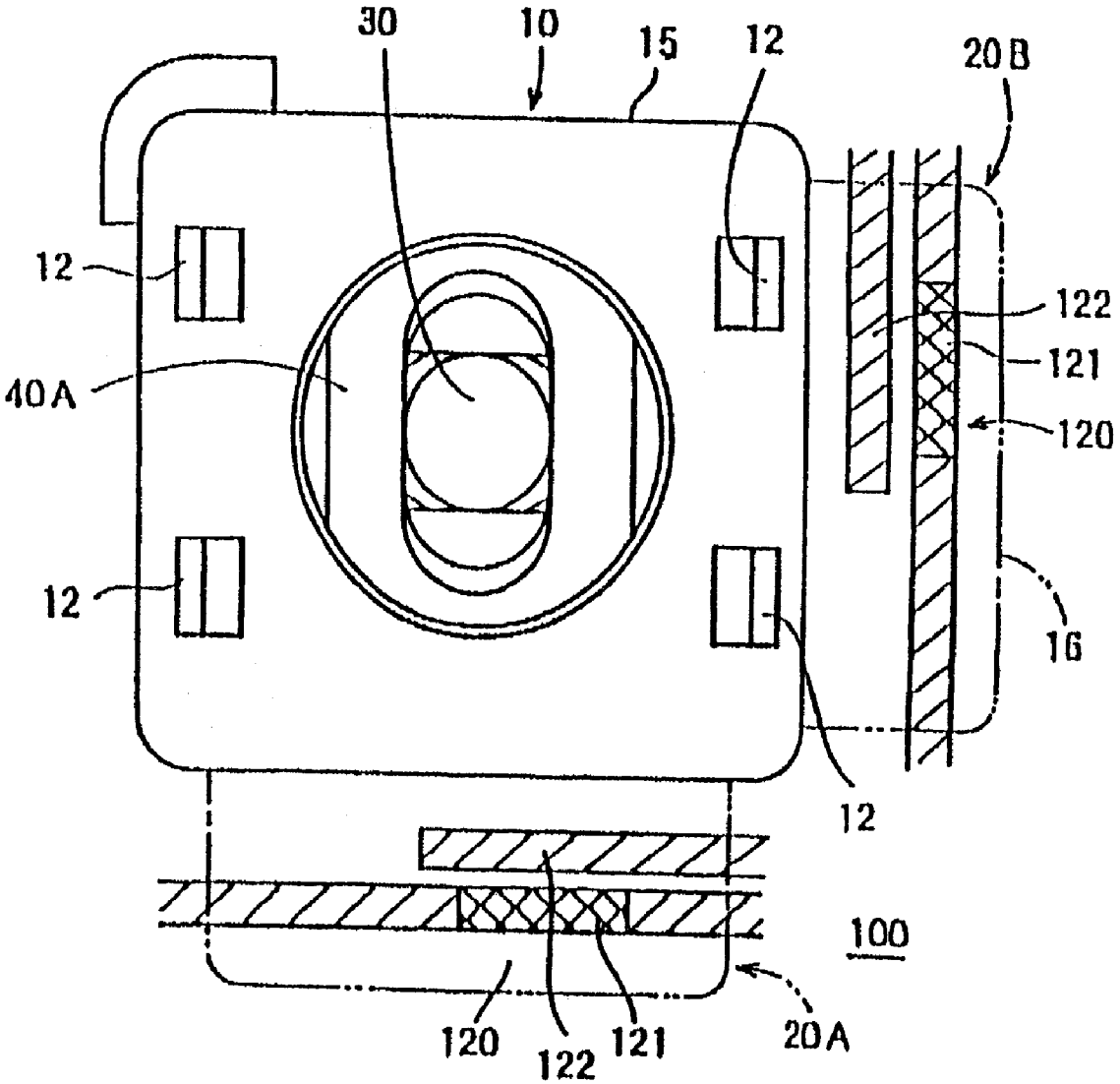
FIG. 8 is a pattern circuit diagram of a resistant circuit combined with the multi-directional input apparatus.

A volume-integral type multi-directional input apparatus according to a second embodiment of the present invention will be explained with reference to FIGS. 7 and 8.

This apparatus is different from the volume-integral type multi-directional input apparatus of the first embodiment shown in FIGS. 1 to 6 mainly in the structure of the contacts 90 and 90.

That is, each of the contact 90 has contact portions 91 and 91 arranged in parallel. The resistance circuit 120 with which the contact portions 91 and 91 come into contact includes the carbon resistor 121 and the conductive portion 122 formed on the surface of the mounting board 100 in parallel. The contact 90 brings the pair of contact portions 91 and 91 into contact with the carbon resistor 121 and the conductive portion 122, thereby bringing them into conduction to constitute the volume.

Other structure is substantially the same as that of the volume-integral type multi-directional input apparatus of the first embodiment and thus, explanation thereof is omitted.

As can be understood from the first and second embodiments, according to the volume-integral type multi-directional input apparatus of the present invention, shape of the resistance circuit 120 and the contact 90 may arbitrarily be selected.

Figure 9:
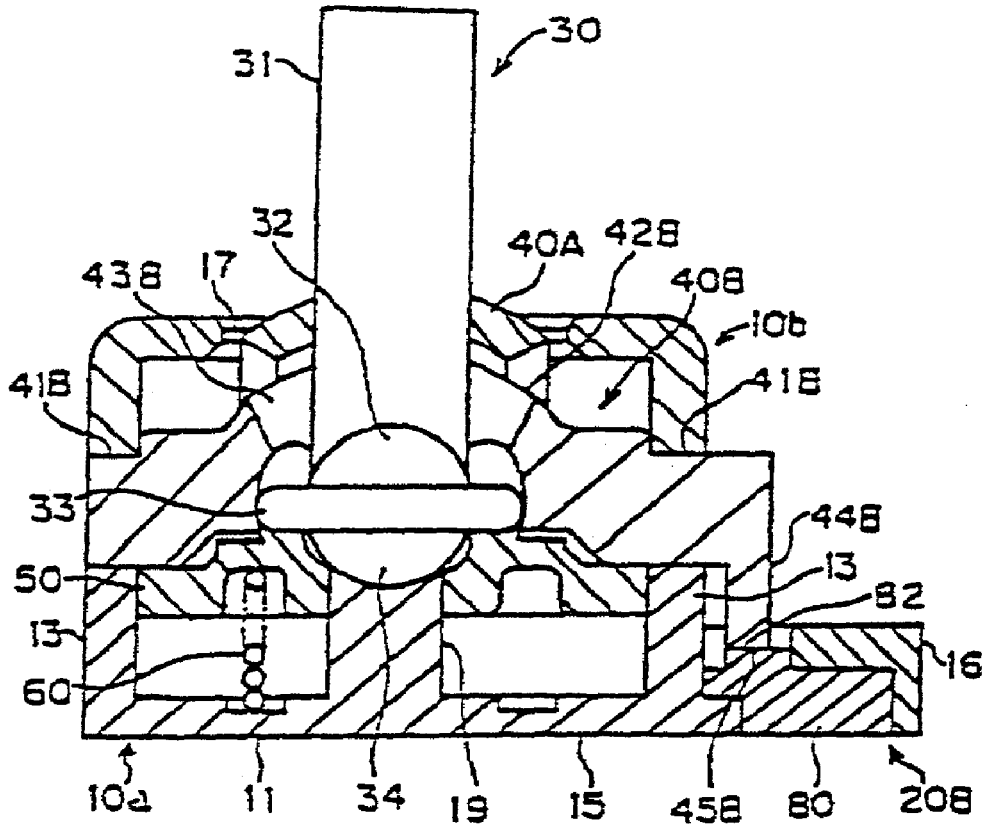
FIG. 9 is a longitudinal sectional front view of a volume-integral type multi-directional input apparatus according to a third embodiment of the present invention.
Figure 10:
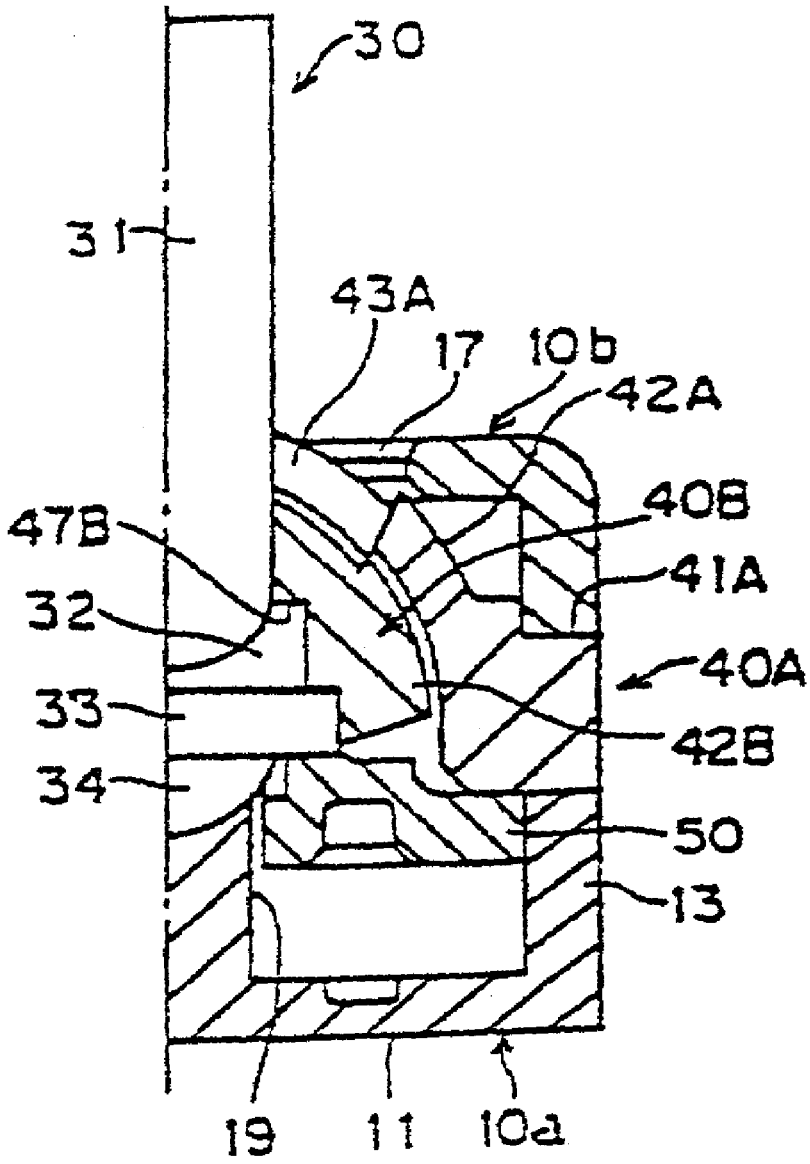
FIG. 10 is a longitudinal sectional side view of the multi-directional input apparatus.
Figure 11:
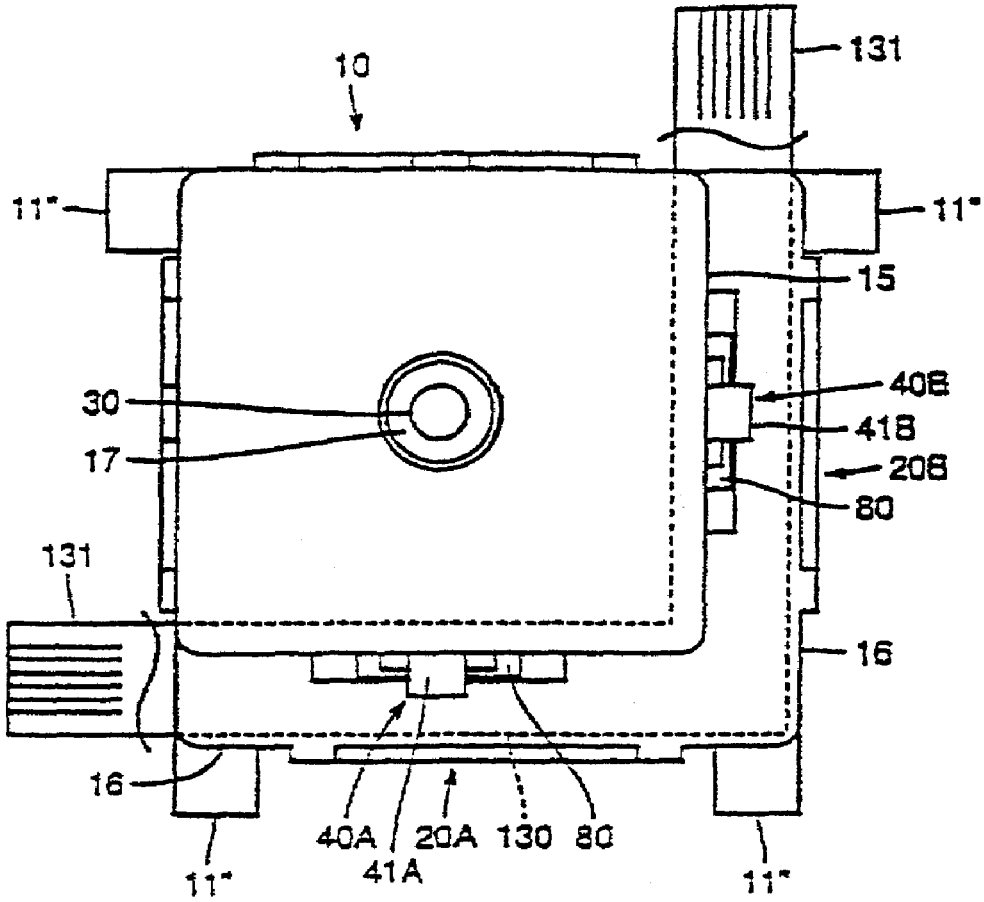
FIG. 11 is a plan view of a volume-integral type multi-directional input apparatus according to a fourth embodiment of the present invention.

A volume-integral type multi-directional input apparatus according to a third embodiment of the present invention will be explained with reference to FIGS. 9 and 10.

This apparatus is different from the volume-integral type multi-directional input apparatuses of the first and second embodiment mainly in that the pushdown switch 110 is omitted. Since the pushdown switch 110 is omitted, the hoisting and lowering member 70 disposed below the operating member 30 is also omitted. The operating member 30 is instead supported from below by a boss 19 provided at a central portion of the bottom plate 11 of the case 10 such that the operating member 30 can be inclined. For supporting the operating member 30, the boss 19 is provided at its upper surface with a downwardly swelling semi-circular recess into which the projection 34 of the operating member 30 is fitted.

Since other structure is substantially the same as that of the volume-integral type multi-directional input apparatuses of the first and second embodiments, explanation thereof is omitted.

As can be understood from these embodiments, the volume-integral type multi-directional input apparatus of the present invention is combined with the pushdown switch 110 when necessary.

A volume-integral type multi-directional input apparatus according to a fourth embodiment of the present invention will be explained with reference to FIGS. 11 to 15.

This apparatus is different from the above-described volume-integral type multi-directional input apparatus mainly in that a resistance circuit constituting the integral type volume is formed on a surface of a reserved board 130, i.e., the a reserved board 130 is used for the volume portions 20A and 20B, and axially intermediate portion of the set of upper and lower turning members 40A and 40B are projected downward, the operating member 30 is supported above the upper turning member 40A so that the turning centers of the turning members 40A and 40B are located as high as possible to restrain the height of the apparatus.

That is, in the volume-integral type multi-directional input apparatus of the fourth embodiment of the present invention, the case 10 is of a two-piece structure comprising a combination of a box-like metal lower case 10*a* and a resin upper case 10*b* fitted to the lower case 10*a* from above.

A downwardly swelling spherical recess 11' (which will be described later) for supporting the lower turning member 40B is disposed on a central portion of the bottom plate 11 of the metal lower case 10*a*. A plurality of projection pieces 11" projecting sideway is formed at four corners of the bottom plate 11 for securing the bottom plate 11 to the mounting board.

Similar to the other volume-integral type multi-directional input apparatus, the resin upper case 10*b* includes the box-like body 15 whose bottom is opened, and the pair of slider accommodating portions 16 and 16 integrally formed on the two crossing side surfaces of the body 15. The body 15 is provided at its ceiling with and opening 17 through which the operating member 30 projects. On a lower surface of the ceiling, an upwardly swelling spherical recess 17' is provided around the opening 17 for supporting the operating member 30. The pair of slider accommodating portions 16 and 16 is integrally formed into an L-shape along the two crossing side surfaces of the body 15.

Figure 12:
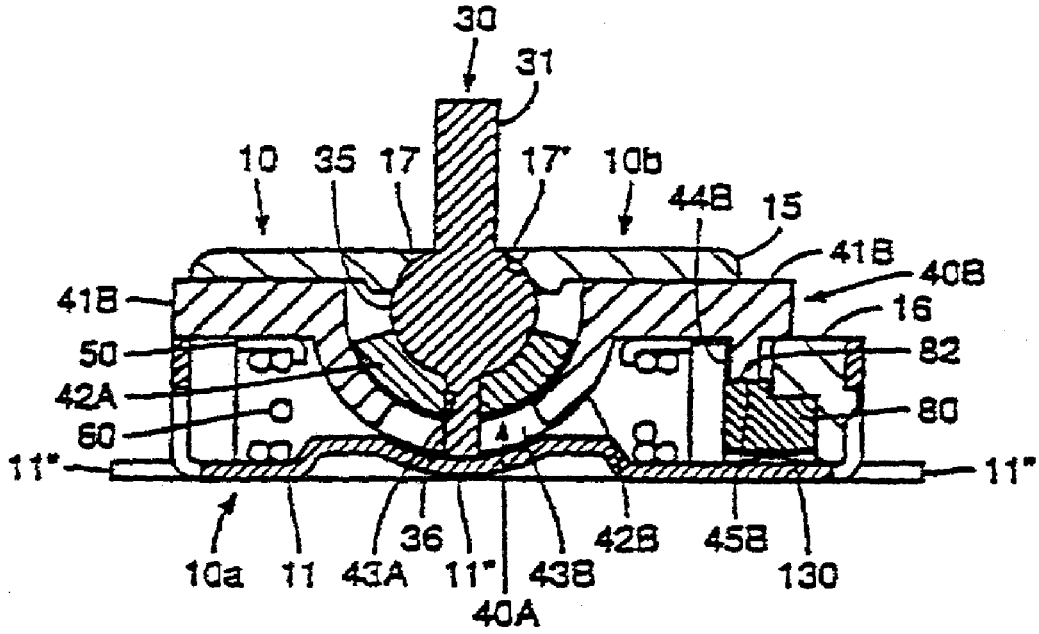
FIG. 12 is a longitudinal sectional front view of the multi-directional input apparatus.
Figure 13:
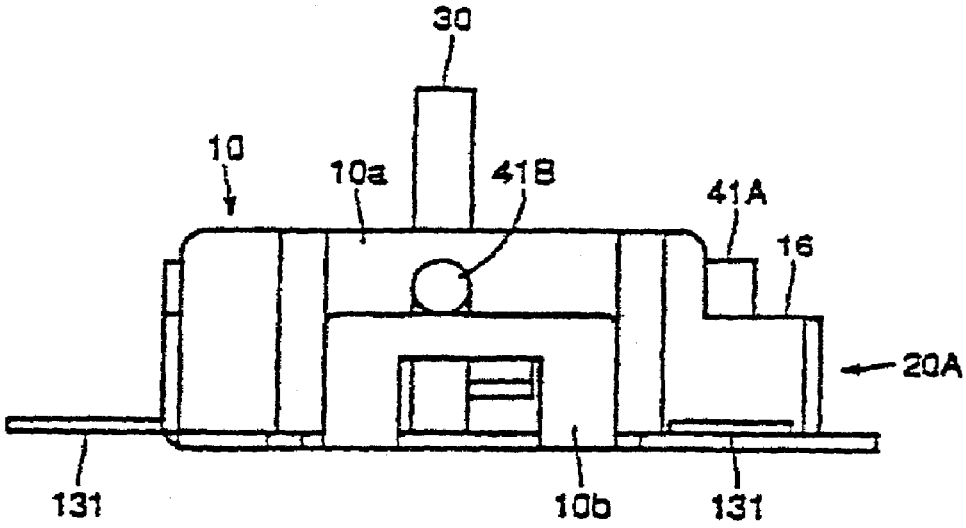
FIG. 13 is a left side view of the multi-directional input apparatus.
Figure 14:
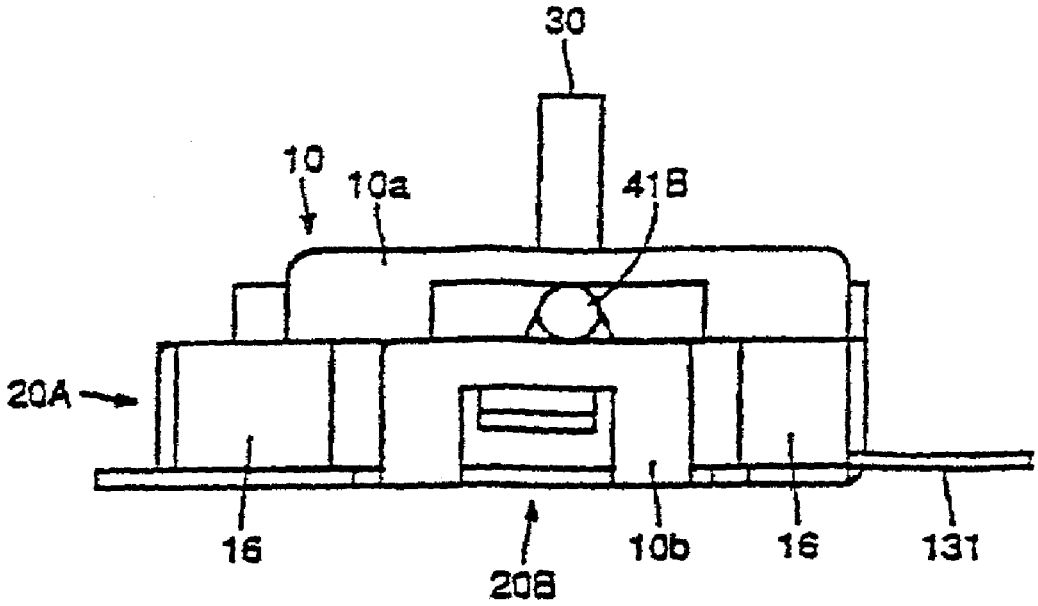
FIG. 14 is a right side view of the multi-directional input apparatus.
Figure 15:
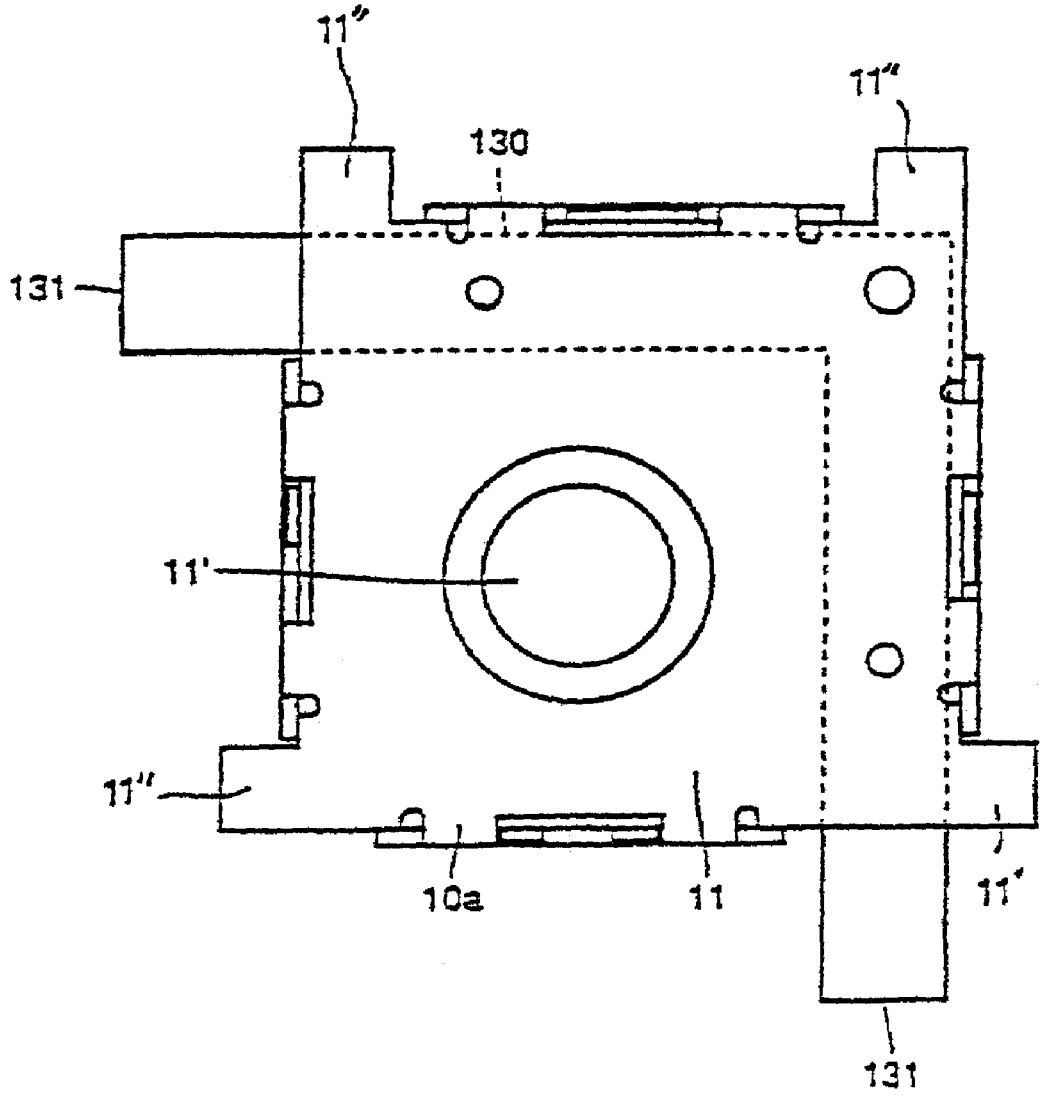
FIG. 15 is a bottom view of the multi-directional input apparatus.
Figure 16:
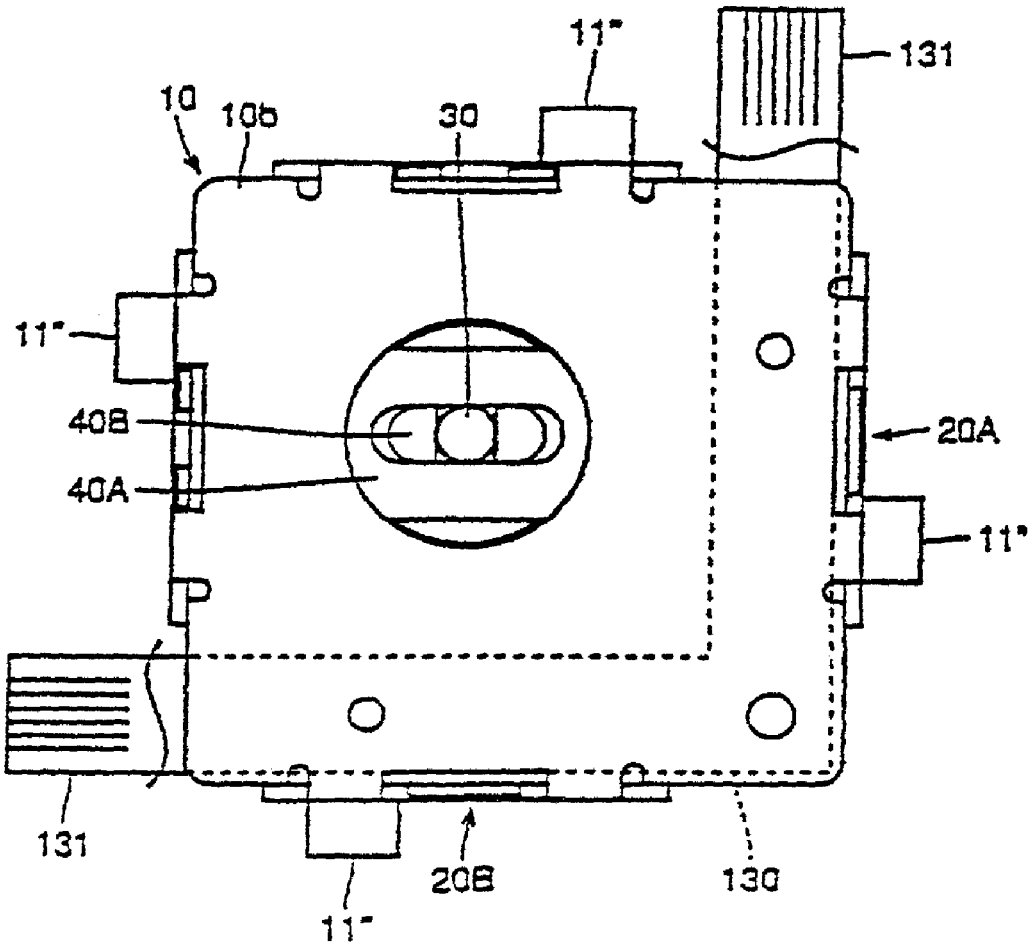
FIG. 16 is a plan view of a volume-integral type multi-directional input apparatus according to a fifth embodiment of the present invention.
Figure 17:
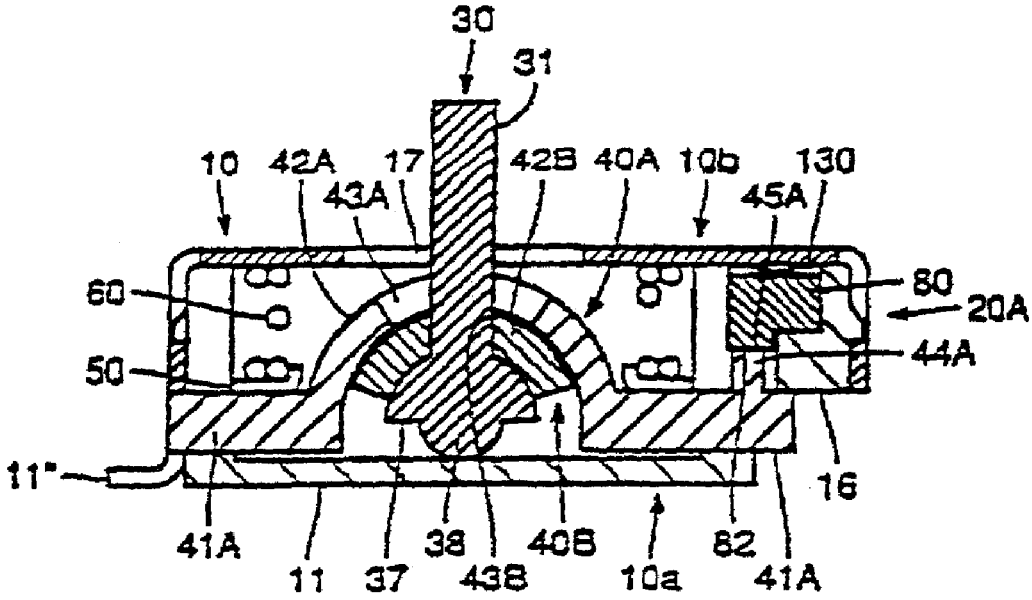
FIG. 17 is a longitudinal sectional front view of the multi-directional input apparatus.
Figure 18:
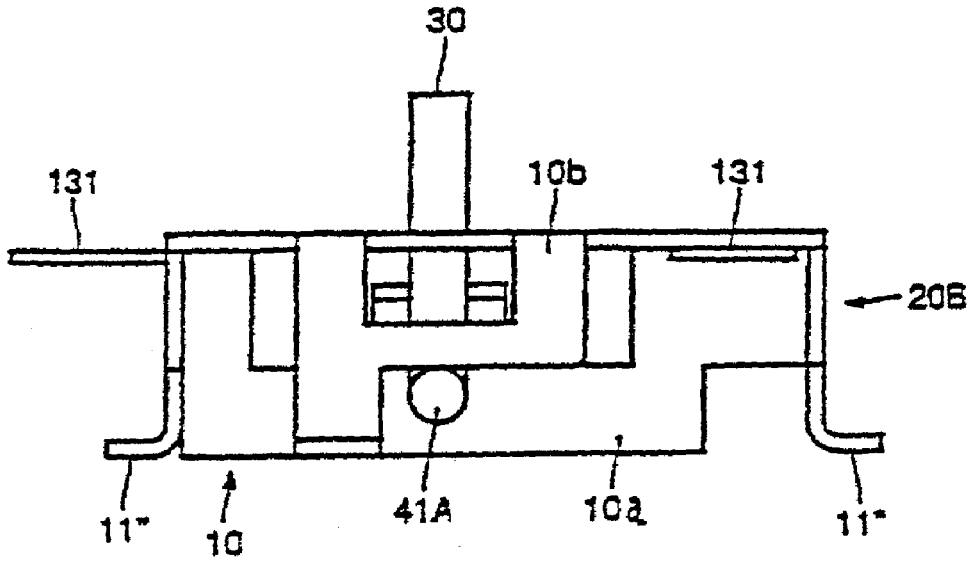
FIG. 18 is a left side view of the multi-directional input apparatus.
Figure 19:
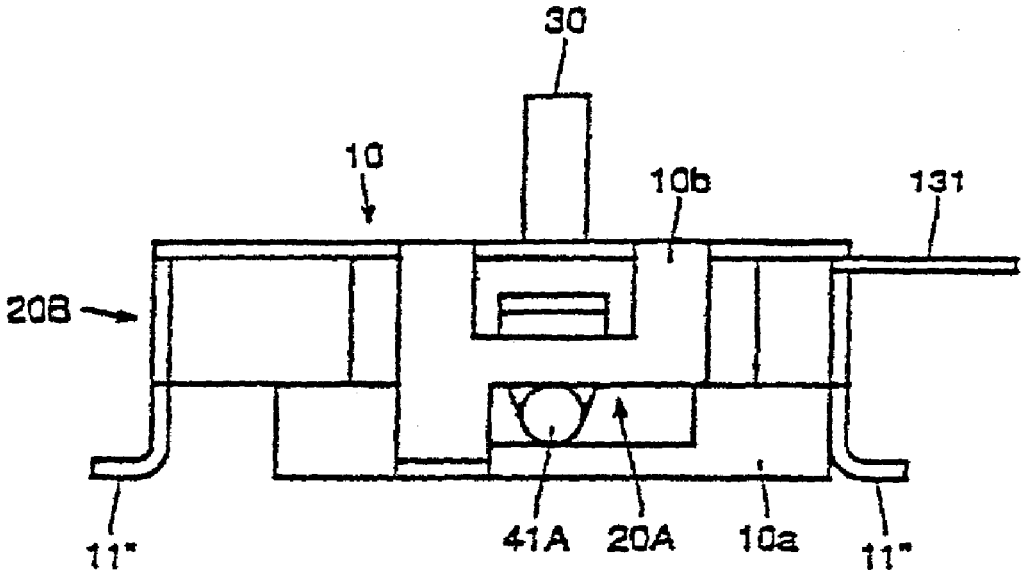
FIG. 19 is a right side view of the multi-directional input apparatus.
Figure 20:
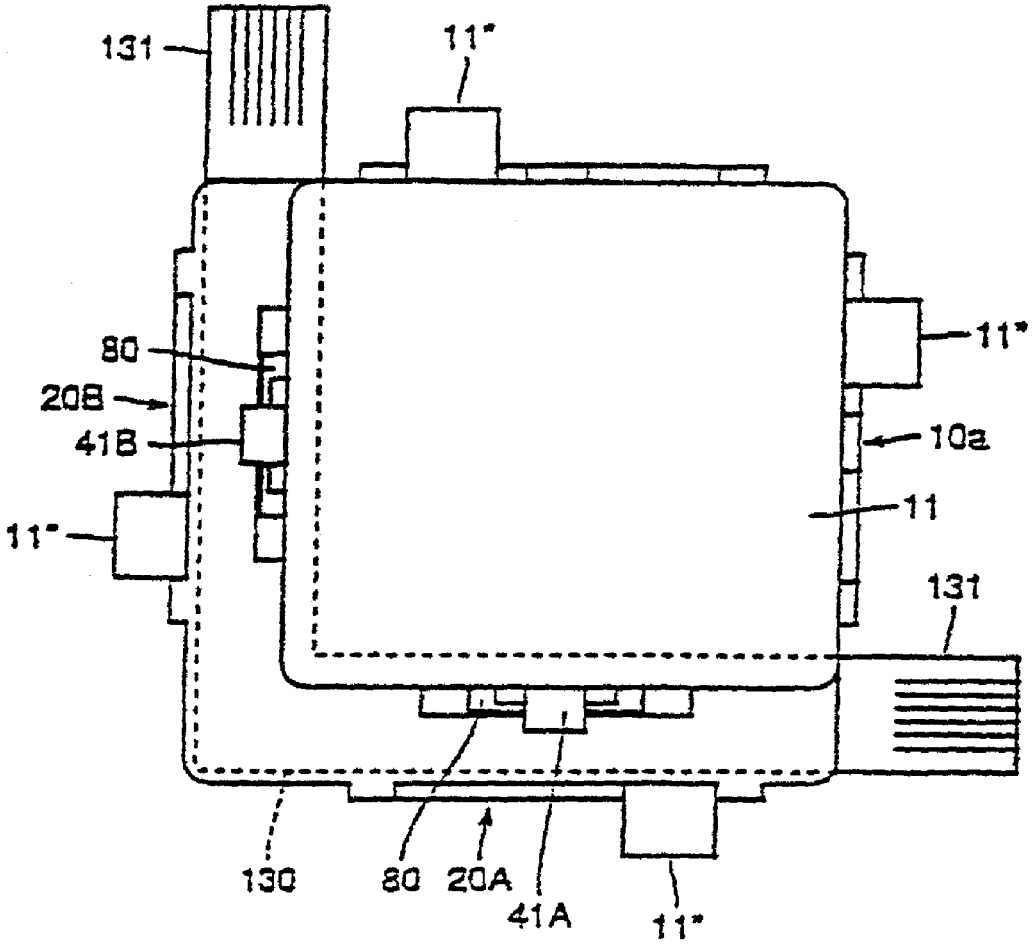
FIG. 20 is a bottom view of the multi-directional input apparatus.

As shown in FIG. 12, the operating member 30 includes a spherical support 35 continuously formed on a lower portion of the rod 31 having a circular cross section, and a rod-like operating portion 36 continuously formed on a lower portion of the support 35.

The upper turning member 40A includes a downwardly swelling arc 42A between the turning shafts 41A and 41A on the opposite ends. The arc 42A is provided with a long hole 43A extending turning center axis of the turning member 40A as a guide hole of the operating member 30. An inner surface of the arc 42A, i.e., an upper surface thereof is formed into a downwardly swelling spherical recess surface into which the spherical support 35 of the operating member 30 is fitted. An outer surface of the arc 42A, i.e., a lower surface thereof is formed into an upwardly swelling spherical projecting surface.

The lower turning member 40B which is combined with the lower portion of the upper turning member 40A perpendicularly includes a downwardly swelling arc 42B between the turning shafts 41B and 41B on the opposite ends. The arc 42B is provided with a long hole 43B extending turning center axis of the turning member 40B as a guide hole of the operating member 30. An inner surface of the arc 42B, i.e., an upper surface thereof is formed into a downwardly swelling spherical recess surface into which the arc 42A of the upper turning member 40A is fitted. An outer surface of the arc 42B, i.e., a lower surface thereof is formed into an upwardly swelling spherical projecting surface which corresponds to the downwardly swelling spherical recess 11'.

The support 35 is grasped between the ceiling of the case 10 and the arc 42A of the upper turning member 40A, thereby rotatably supporting the above-described operating member 30. The operating portion 36 of the operating member 30 is inserted into the long holes 43A and 43B formed in the arcs 42A and 42B of the turning members 40A and 40B.

Similar to the other volume-integral type multi-directional input apparatus, the hoisting and lowering slider 50 for resiliently holding the operating member 30 at the neutral position is disposed below the turning members 40A and 40B, and is biased upward by the spring 60 compressed and accommodated between the hoisting and lowering slider 50 and the bottom plate 11 of the case 10. The hoisting and lowering slider 50 is biased and resiliently brought into contact with flat surfaces formed on the lower surfaces of the turning members 40A and 40B, thereby holding the operating member 30 and the turning members 40A and 40B at the neutral position.

The straight-ahead sliders 80 and 80 are accommodated in the slider accommodating portions 16 and 16 of the case 10, and an L-shaped reserved board 130 is accommodated astride the slider accommodating portions 16 and 16. The straight-ahead sliders 80 and 80 can move horizontally along the two crossing side surfaces of the body 15 of the case 10. A rack gear teeth 82 is formed on an upper surface of each the straight-ahead slider 80. Downwardly directed fan-like gears 44A and 44B formed on one ends of the turning members 40A and 40B are meshed with the rack gear teeth 82 and 82.

The L-shaped reserved board 130 is a flexible board, and disposed in the slider accommodating portions 16 and 16 below the straight-ahead sliders 80 and 80. A pair of resistance circuits corresponding to the straight-ahead sliders 80 and 80 are printed on the reserved board 130. Contacts mounted on the lower surfaces of the straight-ahead sliders 80 and 80 are in contact with the pair of resistance circuits resiliently. The opposite ends of the reserved board 130 are projected outward from the slider accommodating portions 16 and 16 as connecting portions 131 and 131 with respect to the mounting board.

Similar to the other volume-integral type multi-directional input apparatus, in the volume-integral type multi-directional input apparatus of the fourth embodiment of the present invention, the turning members 40A and 40B are turned when the operating member 30 is inclined. With this movement, the straight-ahead sliders 80 and 80 are straightly moved in the volume portions 20A and 20B, the contacts slide on the pair of resistance circuits of the reserved board 130, and a signal corresponding to the direction and the amount of operation of the operating member 30 is input to the electronic equipment which uses the multi-directional input apparatus.

The reserved board 130 is used in the volume sections 20A and 20B and thus, the number of parts is slightly increased, but it is unnecessary to form the resistance circuits constituting the volume sections 20A and 20B on the surface of the board. Therefore, burden of a user using this multi-directional input apparatus is lightened. Further, the reserved board 130 is bent into the L-shape along the two crossing side surface of the body 15 of the case 10, and the reserved board 130 is commonly used by the volume sections 20A and 20B. Therefore, the increase in the number of parts caused by the reserved board 130 is minimized.

Further, the arcs 42A and 42B of the turning members 40A and 40B are projected downward, the support 35 of the operating member 30 is supported by the ceiling of the case 10 and the upper arc 42A, and the turning center is located above the case 10 and thus, space for accommodating the hoisting and lowering slider 50 and the spring 60 is secured below the turning members 40A and 40B, and the entire height of the case 10 is restricted.

A volume-integral type multi-directional input apparatus according to a fifth embodiment of the present invention will be explained with reference to FIGS. 16 to 20.

This apparatus is different from the volume-integral type multi-directional input apparatus of the fourth embodiment of the present invention mainly in that the arcs 42A and 42B of the turning members 40A and 40B are projected upward, space for accommodating the hoisting and lowering slider 50 and the spring 60 is secured above the arcs 42A and 42B, and in connection with this, the reserved board 130 is disposed above the straight-ahead sliders 80 and 80.

That is, according to the volume-integral type multi-directional input apparatus of the fifth embodiment of the present invention, the case 10 comprises the resin lower case 10*a* forming the bottom plate, and a metal upper case 10*b* to be put on the lower case 10*a* from above. The slider accommodating portions 16 and 16 for accommodating the straight-ahead sliders 80 and 80 are integrally and continuously formed on the resin lower case 10*a*.

The turning members 40A and 40B includes upwardly swelling arcs 42A and 42B between the opposite end turning shafts. Unlike the other volume-integral type multi-directional input apparatus, the hoisting and lowering slider 50 is disposed above the turning members 40A and 40B, and is biased downward by the spring 60 compressed and accommodated between the hoisting and lowering slider 50 and the ceiling of the case 10. The hoisting and lowering slider 50 is biased and resiliently brought into contact with flat surfaces formed on the lower surfaces of the turning members 40A and 40B, thereby holding the operating member 30 and the turning members 40A and 40B at the neutral position.

The operating member 30 includes an upwardly swelling semi-spherical first support 37 below the shaft 31, and a downwardly swelling semi-spherical second support 38 below the first support 37. The first support 37 is fitted into the arc 42B of the lower turning member 40B from below, and the second support 38 is supported on the bottom plate 11 of the case 10.

The straight-ahead slider 80 is accommodated in the slider accommodating portion 16, and the reserved board 130 is accommodated in the slider accommodating portion 16 above the straight-ahead slider 80. The straight-ahead slider 80 is provided at its lower surface with the rack gear teeth 82. Upwardly directed fan-like gears 44A and 44B are formed on one ends of the turning members 40A and 40B are meshed with the teeth 82. The contact is mounted to the upper surface of the straight-ahead slider 80. The contact is in resilient contact with the resistance circuit formed on the lower surface of the reserved board 130.

Other structure is the same as that of the volume-integral type multi-directional input apparatus of the fourth embodiment.

The reserved board 130 is used in the volume-integral type multi-directional input apparatus of the fifth embodiment of the present invention and thus, the number of parts is slightly increased, but it is unnecessary to form the resistance circuits constituting the volume sections 20A and 20B on the surface of the board. Therefore, burden of a user using this multi-directional input apparatus is lightened. Further, the reserved board 130 is bent into the L-shape along the two crossing side surface of the body 15 of the case 10, and the reserved board 130 is commonly used by the volume sections 20A and 20B. Therefore, the increase in the number of parts caused by the reserved board 130 is minimized.

Further, the arcs 42A and 42B of the turning members 40A and 40B are projected upward, the supports 37 and 38 of the operating member 30 is supported between the lower arc 42B and the bottom plate 11 of the case 10, and the turning centers thereof are located as low as possible in the case 10 and thus, space for accommodating the hoisting and lowering slider 50 and the spring 60 is secured above the turning members 40A and 40B, and the entire height of the case 10 is restricted.

As can be understood from the fourth and fifth embodiments, the volume-integral type multi-directional input apparatus of the present invention can use the reserved board 130 for forming the resistance circuit. The reserved board 130 may be disposed either above or below the straight-ahead sliders 80 and 80.

Figure 21:
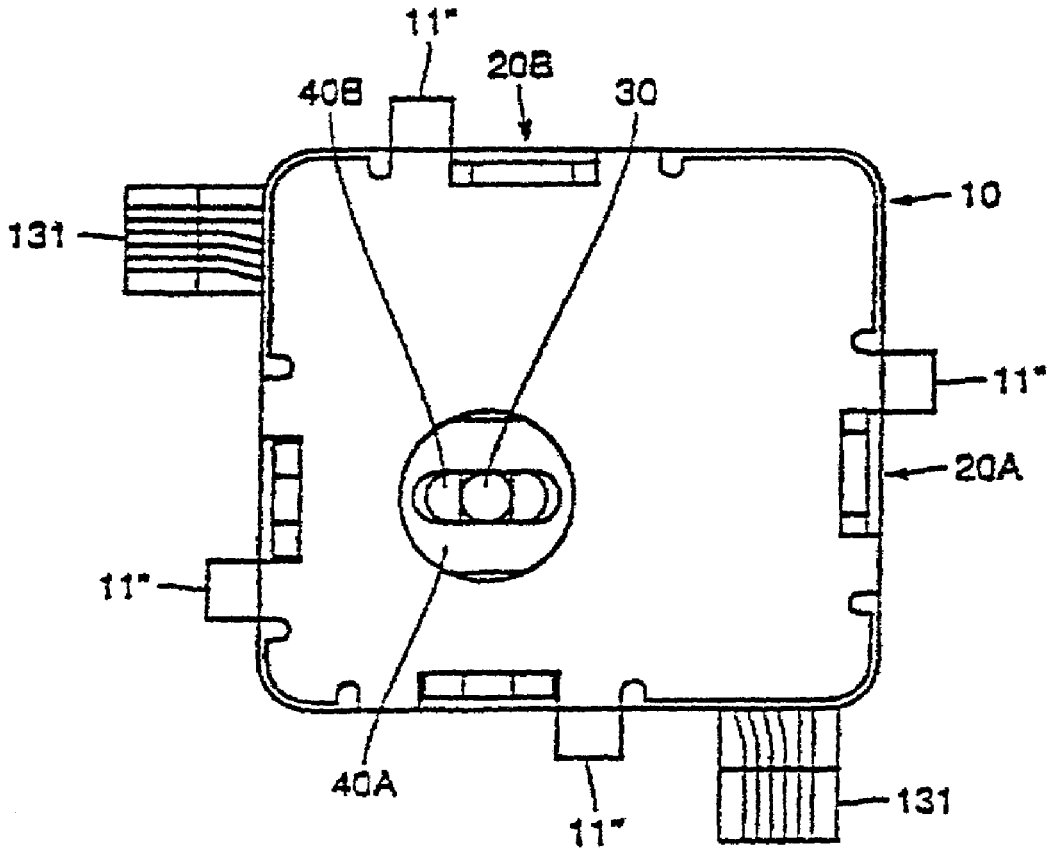
FIG. 21 is a plan view of a volume-integral type multi-directional input apparatus according to a sixth embodiment of the present invention.
Figure 22:
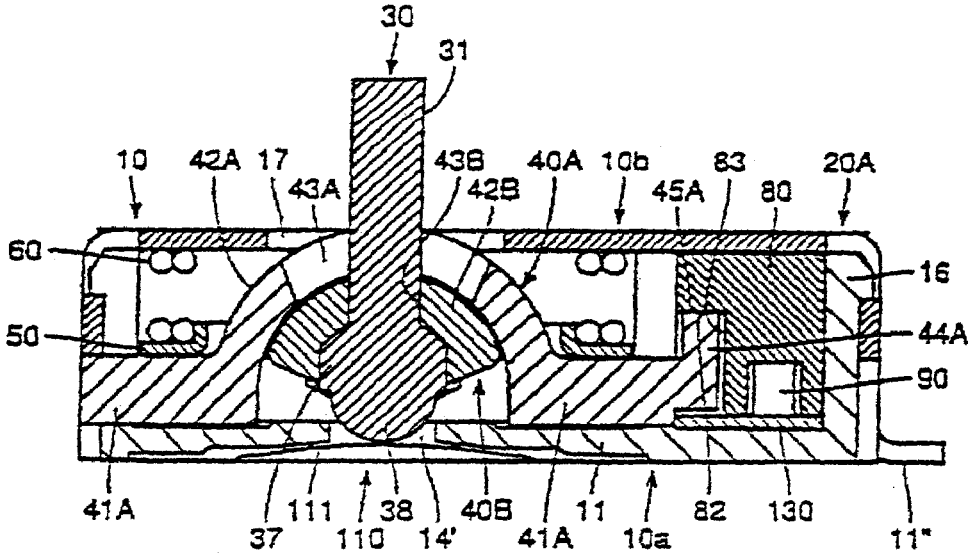
FIG. 22 is a longitudinal sectional front view of the multi-directional input apparatus.
Figure 23:
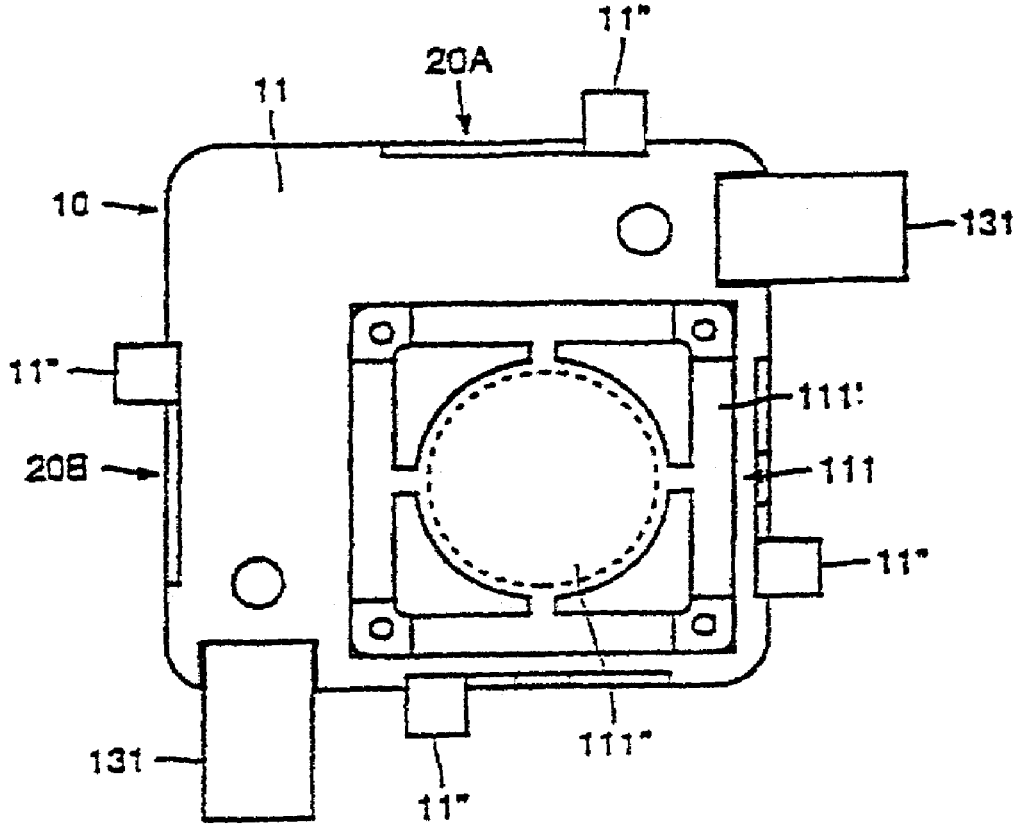
FIG. 23 is a bottom view of the multi-directional input apparatus.

A volume-integral type multi-directional input apparatus according to a sixth embodiment of the present invention will be explained with reference to FIGS. 21 to 23.

This apparatus is different from the volume-integral type multi-directional input apparatus of the fifth embodiment of the present invention mainly in that the lower pushdown switch 110 is operated by the operating member 30, and the reserved board 130 is disposed in the volume sections 20A and 20B below the straight-ahead slider 80.

That is, according to the volume-integral type multi-directional input apparatus of the sixth embodiment of the persent invention, in order to allow the operating member 30 to move in the axial direction, the bottom plate 11 of the case 10 is formed with an opening 14' below the operating member 30. Further, in order to bias the operating member 30 upward, a snap plate 111 is mounted to a lower surface of the bottom plate 11. The snap plate 111 includes a frame-like support 111' secured to the lower surface of the bottom plate 11 and a circular operating portion 111" supported by radial arms in the snap plate 111'. The snap plate 111 is accommodated in a shallow recess provided in the lower surface of the bottom plate 11, the second support 38 of the operating member 30 is resiliently pushed from above through an opening formed in the bottom plate 11, which constitutes the pushdown switch 110 together with the contact formed on the surface of the mounting board.

Opposite sides of the first support 37 of the operating member 30 are removed for preventing the operating member 30 from rotating around its axis.

The straight-ahead sliders 80 and 80 are accommodated in the slider accommodating portions 16 and 16 of the case 10, and the reserved board 130 is accommodated in the slider accommodating portions 16 and 16 below the straight-ahead sliders 80 and 80. An inner surface of each the straight-ahead slider 80 is provided with a recess 83 which is opened downward. The gears 44A and 44B of the turning members 40A and 40B are inserted into the recess 83. A ceiling of the recess 83 is provided with the rack gear teeth 82 meshing with the upwardly directed gears 44A and 44B. A contact 90 is mounted to the lower surface of each the straight-ahead slider 80, and the contact 90 resiliently comes into contact from above with the resistance circuit formed on the upper surface of the lower reserved board 130.

Other structure is substantially the same as that of the volume-integral type multi-directional input apparatus of the fifth embodiment, the same elements are designated with the same numbers, and detailed explanation thereof is omitted.

According to the volume-integral type multi-directional input apparatus of the sixth embodiment, by pushing down the operating member 30 against the biasing force of the snap plate 111, the snap plate 111 is deformed downward, and the connected portion formed on the surface of the mounting board is short-circuited by this deformed portion. With this, the function of the pushdown switch 110 is obtained.

When the snap plate 111 is mounted to the mounting board, the positional precision between the operating member 30 and the snap plate 111 is lowered, the feel of the pushing down operation of the operating member 30 is not stabilized, but with the volume-integral type multi-directional input apparatus of the sixth embodiment, since the snap plate 111 is mounted on the side of the multi-directional input apparatus, the feeling is stabilized.

In addition, according to the volume-integral type multi-directional input apparatus of the sixth embodiment, although the gears 44A and 44B of the turning members 40A and 40B are meshed with the teeth 82 of the straight-ahead sliders 80 and 80, the reserved board 130 is disposed below the straight-ahead sliders 80 and 80, and the reserved board 130 approaches the mounting board. Therefore, the reserved board 130 can easily be connected to the mounting board.

As can be found from this point, it is preferable to dispose the reserved board 130 below the straight-ahead sliders 80 and 80 in terms of connection with respect to the mounting board. Especially in the sixth embodiment, the height of each of the volume sections 20A and 20B is restrained, and it is possible to rationally design the case 10 whose height is limited.

As described above, according to the volume-integral type multi-directional input apparatus of the present invention, the volume is integrally formed together with the input apparatus as the signal output means which outputs a signal corresponding to the turning angle of the turning member. Therefore, it is possible to largely reduce the number of parts relating the volume, and to reduce the manufacturing cost thereof.

According to another volume-integral type multi-directional input apparatus of the present invention, since the straight-ahead slider constituting the volume is accommodated in the slider accommodating portion integrally formed on the side surface of the case, especially the number of parts is reduced.

According to another volume-integral type multi-directional input apparatus of the present invention, since the motion transmitting mechanism used in the volume is a rack and pinion mechanism, especially the number of parts is reduced.

According to another volume-integral type multi-directional input apparatus of the present invention, since the resistance circuit constituting the volume is formed on the surface of the mounting board to which the case is secured, especially the number of parts is reduced. Further, solder between the mounting board and the case is unnecessary.

According to another volume-integral type multi-directional input apparatus of the present invention, since the resistance circuit is formed on the upper or lower surface of the reserved board for constituting the volume disposed below or above the straight-ahead slider, it is unnecessary to form a resistance circuit on the mounting board, burden of a user using this multi-directional input apparatus is lightened.

According to another volume-integral type multi-directional input apparatus of the present invention, since the reserved board is bent into the L-shape along the two crossing side surfaces, and the reserved board is commonly used by the pair of volumes, especially the number of parts is reduced.

According to another volume-integral type multi-directional input apparatus of the present invention, since the reserved board 130 is accommodated together with the straight-ahead slider in the slider accommodating portion 16 integrally formed on the side surface of the case, especially the number of parts is reduced.

According to another volume-integral type multi-directional input apparatus of the present invention, since the reserved board is the flexible board, the mounting board can easily be connect to the reserved board.

INDUSTRIAL APPLICABILITY

The present invention can be utilized as an input device of a personal computer, a game machine and the like.

The invention claimed is:

1. A volume-integral type multi-directional input apparatus comprising a case secured on a mounting board; a set of upper and lower turning members supported in said case such that said turning members can turn into two intersecting directions and each having a long hole extending in a direction perpendicular to said turning direction; an operating member passing through each of said long holes of said set of upper and lower turning members, said operating member turning each of said turning members when said operating member is operated in arbitrary direction therearound; and a set of signal output means for outputting signal corresponding to a turning angle of each of said turning members; wherein said set of signal output means comprise a pair of straight-ahead sliders mounted to said case such that said straight-ahead sliders move straightly along a side surface of said case above said mounting board, a pair of motion transmitting mechanisms for converting turning movements of said set of upper and lower turning members into straight movements and transmitting said straight movements to said pair of straight-ahead sliders, and a pair of contacts sliding on resistance circuits when said straight-ahead sliders move straightly, thereby constituting volumes.

2. The volume-integral type multi-directional input apparatus according to claim 1, wherein said straight-ahead sliders are accommodated in slider accommodating portions integrally formed on a side surface of said case.

3. The volume-integral type multi-directional input apparatus according to claim 1, wherein in each of said motion transmitting mechanisms, a gear provided on an end of said turning member meshes with a rack gear teeth formed on a surface of said straight-ahead slider.

4. The volume-integral type multi-directional input apparatus according to claim 1, wherein each of said resistance circuit is formed on a surface of said mounting board to which said case is secured, and said contact is mounted to a lower surface of said straight-ahead slider.

5. The volume-integral type multi-directional input apparatus according to claim 1, wherein each of said resistance circuit is formed on an upper or lower surface of a reserved board for constituting said volume, and said contact is mounted to a lower or upper surface of said straight-ahead slider.

6. The volume-integral type multi-directional input apparatus according to claim 5, wherein said reserved board is bent into an L-shape along two crossing side surfaces of said case, and is commonly used by said pair of volumes.

7. The volume-integral type multi-directional input apparatus according to claim 5, wherein said reserved board is accommodated together with said straight-ahead slider in a slider accommodating portion which is integrally formed on a side surface of said case.

8. The volume-integral type multi-directional input apparatus according to claim 5, wherein said reserved board is a flexible board.

* * * * *